US006453969B1

(12) United States Patent
Ferrara

(10) Patent No.: US 6,453,969 B1
(45) Date of Patent: Sep. 24, 2002

(54) VISCOUS CLUTCH FOR A CORRECTION TAPE REEL ASSEMBLY

(75) Inventor: Daniel A. Ferrara, Morris, CT (US)

(73) Assignee: BIC Corporation, Milford, CT (US)

( * ) Notice: Subject to any disclaimer, the term of this patent is extended or adjusted under 35 U.S.C. 154(b) by 24 days.

(21) Appl. No.: 09/722,469

(22) Filed: Nov. 28, 2000

(51) Int. Cl.[7] ..... B32B 31/00

(52) U.S. Cl. ..... 156/577; 156/579; 118/76; 118/257; 242/160.4; 242/171; 242/588.6

(58) Field of Search ..... 156/238, 523, 156/527, 540, 574, 577, 579; 242/160.2, 160.4, 170, 171, 588, 588.2, 588.3, 588.6; 225/46; 118/76, 200, 257

(56) References Cited

U.S. PATENT DOCUMENTS

| | | | | |
|---|---|---|---|---|
| 4,271,945 | A | 6/1981 | Budinski | 192/58 B |
| 4,302,156 | A | 11/1981 | LaFlame | 416/169 |
| 4,350,453 | A | 9/1982 | Field et al. | 400/208 |
| 4,838,119 | A | 6/1989 | Teraoka et al. | 74/711 |
| 4,874,071 | A | 10/1989 | White | 192/58 B |
| 5,025,906 | A | 6/1991 | O'Neil et al. | 192/58 B |
| 5,070,975 | A | 12/1991 | Tanaka et al. | 192/35 |
| 5,176,235 | A | 1/1993 | Williams | 192/58 |
| 5,221,577 | A | 6/1993 | Inaba et al. | 428/354 |
| 5,299,985 | A | 4/1994 | Johnston | 475/53 |
| 5,310,437 | A | 5/1994 | Tucker | 156/238 |
| 5,346,043 | A | 9/1994 | Haka | 192/3.29 |
| 5,393,368 | A | 2/1995 | Stevens | 156/577 |
| 5,711,741 | A | 1/1998 | Inoue | 476/10 |
| 5,714,035 | A | 2/1998 | Stevens | 156/577 |
| 5,759,270 | A | 6/1998 | Lee | 118/257 |
| 5,766,108 | A | 6/1998 | Johnston | 475/91 |
| 5,795,085 | A | 8/1998 | Yoo | 400/248 |
| 5,842,945 | A | 12/1998 | Inoue | 475/207 |
| 5,938,115 | A | 8/1999 | Aoki et al. | 237/12.3 R |
| 5,942,036 | A | 8/1999 | You | 118/257 |
| 6,027,032 | A | 2/2000 | Aoki et al. | 237/12.3 R |
| 6,059,008 | A | 5/2000 | Yoshida et al. | 160/296 |
| 6,062,286 | A | 5/2000 | Koyama et al. | 156/540 |

FOREIGN PATENT DOCUMENTS

| | | | |
|---|---|---|---|
| JP | 354059912 | * | 5/1979 |
| JP | 401169766 | * | 7/1989 |

* cited by examiner

*Primary Examiner*—Mark A. Osele
(74) *Attorney, Agent, or Firm*—Pennie & Edmonds LLP

(57) ABSTRACT

The invention relates to a reel assembly for a tape dispenser that includes a supply reel and a take-up reel. The reel assembly incorporates a clutch in the form of a viscous material disposed between a portion of the supply reel and a portion of the take-up reel. The viscous material serves to couple and provide controlled drag between the supply reel and take-up reel in order to properly tension a correction tape as it is dispensed from a correction tape dispenser. The invention also relates to a tape dispenser that utilizes a reel assembly having a viscous clutch and a tape cartridge. The reel assembly is preferably used in a correction tape dispenser for applying a correction film to a substrate.

32 Claims, 10 Drawing Sheets

VISCOUS CLUTCH FOR A CORRECTION TAPE REEL ASSEMBLY

FIELD OF THE INVENTION

The present invention relates generally to a dispenser for applying a correction film to a substrate surface. More particularly, the invention relates to a reel assembly for a correction tape dispenser that utilizes a viscous clutch for maintaining proper tension in the correction tape.

BACKGROUND OF THE INVENTION

A number of devices are known that are designed to apply a correction film to a surface. The correction film includes an adhesive surface that adheres to the surface of a substrate and is generally provided on a carrier tape. The correction film is typically adhered to the surface of a substrate by applying pressure against the tape at the surface. Examples of previously known devices include those described in U.S. Pat. Nos. 5,310,437, 5,942,036, and 6,062,286. Correction tape of this type is also utilized in typewriters. An example of a correction tape cartridge that is utilized in a typewriter is described in U.S. Pat. No. 4,350,453.

Correction tape dispensers take on a variety of forms and are generally formed of a housing having a supply reel or spool containing the correction film and carrier tape, and a second take-up spool or reel for accepting the tape after usage. The tape is fed over an applicator member, which extends from the housing. The device is held in the hand of a user who applies pressure to the applicator member on a surface at a pressure sufficient to transfer the film from the tape to the surface.

Dispensers are designed so that movement of the tape over a substrate surface causes the tape to unwind from the supply reel while maintaining a tension on the tape so that rotation of the supply reel causes the take-up reel to wind and accept the spent tape. It is desirable to maintain a tension on the tape so that it can be wound on the take-up reel, but the tension must not be so great as to break the tape. In order to maintain the proper tension, a clutch is normally provided to connect the take-up reel to the supply reel. A clutch allows for slippage during application while maintaining the proper tension in the tape to ensure effective feeding of the tape over the applicator member.

Applicator devices may have a single reel design, such as that disclosed in U.S. Pat. No. 5,310,437, or a double reel design, such as disclosed in U.S. Pat. No. 6,062,286. A single reel dispenser is one in which the supply reel and take-up reel are aligned along a common axis while a double reel dispenser typically includes two different axes.

U.S. Pat. No. 5,310,437 describes a device where the supply reel has a diameter that is smaller than the diameter of the take-up reel. The take-up reel includes a plurality of knurls and an arcuate leaf spring that seats on the spent tape as the tape passes over the knurls. The tape does not wind around the take-up reel. Instead, the tape passes over the take-up reel and may be stored or cut off. Due to the difference between the diameters of the take-up reel and supply reel, the tape is moved at a greater linear rate over the knurls of the take-up reel than it is being unwound from the outer surface of the supply reel. When this occurs, slippage takes place between the knurls and the leaf spring, maintaining tension in the tape throughout its travel from the supply reel to the take-up reel. The leaf spring in combination with the knurls creates a form of slip clutch between the take-up reel and the supply reel.

U.S. Pat. No. 6,062,286 describes a device with two reels disposed on different shafts that includes a clutch for synchronizing the supply speed and take-up speed. The supply reel is mounted on a support shaft formed integrally with the inner side of the case body. The take-up reel recovers the spent tape and is positioned on a separate support shaft. The clutch mechanism includes engaging protrusions and an engaging support member. The engaging protrusions function as frictional engaging members.

It is desirable to provide an improved clutch mechanism which is reliable, simple, and inexpensive to manufacture.

SUMMARY OF THE INVENTION

The present invention is directed toward a reel assembly for use in a tape dispenser, to a cartridge for housing a reel assembly, and to a tape dispenser, preferably a correction tape dispenser. The reel assembly of one embodiment of the present invention includes a supply reel, a take-up reel in mating association with the supply reel, and a viscous material positioned between the supply reel and the take-up reel. The viscous material serves as a clutch between the supply reel and the take-up reel and provides controlled drag between the supply reel and the take-up reel in order to properly tension a tape being dispensed from the tape dispenser.

The take-up reel includes a mating portion for mating with a mating portion of the supply reel. The viscous material is provided between the mating portion of the supply reel and the mating portion of the take-up reel. The area between the mating portions of the supply and take-up reels may be substantially disk shaped. The viscous material may be a silicone fluid. Alternatively, the viscous material may include a mixture of silicone gum and a silicone fluid.

A seal may be provided between the take-up reel and the supply reel and may be configured and dimensioned to retain the viscous fluid between the take-up reel and the supply reel. The seal may extend outwardly from and be integral with the wall of the take-up reel. Alternatively, the seal may be an independent member positioned between the supply reel and the take-up reel in the vicinity of the viscous material.

The reel assembly may include a mechanism for increasing the friction between the supply reel and the take-up reel. In one embodiment of the invention, at least one rib may be positioned on at least one of the supply reel or the take-up reel. The rib is for association with the viscous material. The rib may be a concentric rib or a radial rib. Alternatively, or in combination therewith, a surface treatment may be provided on at least one of the supply reel or the take-up reel. The surface treatment is also in association with the viscous material.

Dimensional controls may be provided on the reel assembly. The dimensional controls ensure that an area is maintained between at least part of the supply reel and at least part of the take-up reel for holding the viscous material. The dimensional controls may include a cylindrical wall of the supply reel that abuts a surface of the take-up reel.

The supply reel includes a tape carrier surface for holding a roll of correction tape. The take-up reel may also include a tape carrier surface for accepting spent correction tape. Both tape carrier surfaces have a diameter, and the supply reel tape carrier surface may have a diameter that is smaller than the diameter of the take-up reel tape carrier surface. The supply reel has an axis and the take-up reel has an axis. In one embodiment, the axis of the take-up reel is not coaxial with the axis of the supply reel.

The reel assembly may also include a knob associated with at least one of the supply reel or the take-up reel for rotating the supply reel or the take-up reel relative to the other reel in order to free the supply reel from the take-up reel.

One embodiment of the present invention also relates to a cartridge for housing a reel assembly of a tape dispenser, preferably a correction tape dispenser. The cartridge includes a reel assembly and a body for housing the reel assembly. The body has at least one opening defined therein for the entrance and exit of a tape. The body may include a top shell portion and a bottom shell portion, with the top and bottom shell portions in mating association with one another. The body is configured and dimensioned for insertion into a tape dispenser, preferably a correction tape dispenser.

In another embodiment, the present invention also relates to a tape dispenser that includes a body, a reel assembly, a dispenser tip, and tape. The body forms the outside of the tape dispenser. The tape dispenser is preferably a correction tape dispenser. The reel assembly is positioned within the body and has a viscous clutch. The dispenser tip is positioned within the body and has a portion that extends from the body. The tape is disposed on the reel assembly and extends from the reel assembly around the dispenser tip and back to the reel assembly. The reel assembly may be mounted on a boss that extends from the body of the tape dispenser.

The reel assembly includes a take-up reel and a supply reel. The supply reel houses a roll of unused (correction) tape and the take-up reel houses the spent (correction) tape. The take-up reel includes a mating portion for mating with a mating portion of the supply reel, the viscous clutch positioned between the mating portion of the take-up reel and the mating portion of the supply reel. The area defined between the mating portion of the supply reel and the mating portion of the take-up reel may be substantially disk shaped.

The viscous clutch includes a viscous material that is provided between the mating portion of the take-up reel and the mating portion of the supply reel. The viscous material provides controlled drag between the supply reel and the take-up reel in order to properly tension the (correction) tape being dispensed from the supply reel to the take-up reel. The viscous material may be a silicone substance. In one embodiment, the viscous material is a mixture of at least silicone gum and silicone fluid.

A surface treatment may be provided on at least one of the mating portions of the supply reel or the take-up reel. The surface treatment may be in intimate contact with the viscous material. In addition, a knob may be associated with the reel assembly for manually rotating at least one of the take-up reel or the supply reel. The knob is accessible from outside the body.

BRIEF DESCRIPTION OF THE DRAWINGS

Preferred features of the present invention are disclosed in the accompanying drawings, wherein identical reference characters denote like elements throughout the several views, and wherein:

FIG. 4 collectively refers to FIGS. 4A–4D, wherein:

FIG. 5 collectively refers to FIGS. 5A–5D, wherein:

FIG. 6 collectively refers to FIGS. 6A–6C, wherein:

FIG. 7 collectively refers to FIGS. 7A and 7B, wherein:

FIG. 8 collectively refers to FIGS. 8A and 8B, wherein:

DETAILED DESCRIPTION OF THE INVENTION

The present invention relates in one aspect to a reel assembly that incorporates a viscous clutch. The reel assembly is generally intended for use in a correction tape dispenser, or a replacement cartridge. However, other applications, such as, for example, those applications that utilize a reel assembly, are anticipated to derive a benefit from using the clutch of the present invention, and are believed to be within the scope of the invention.

Figure 1:
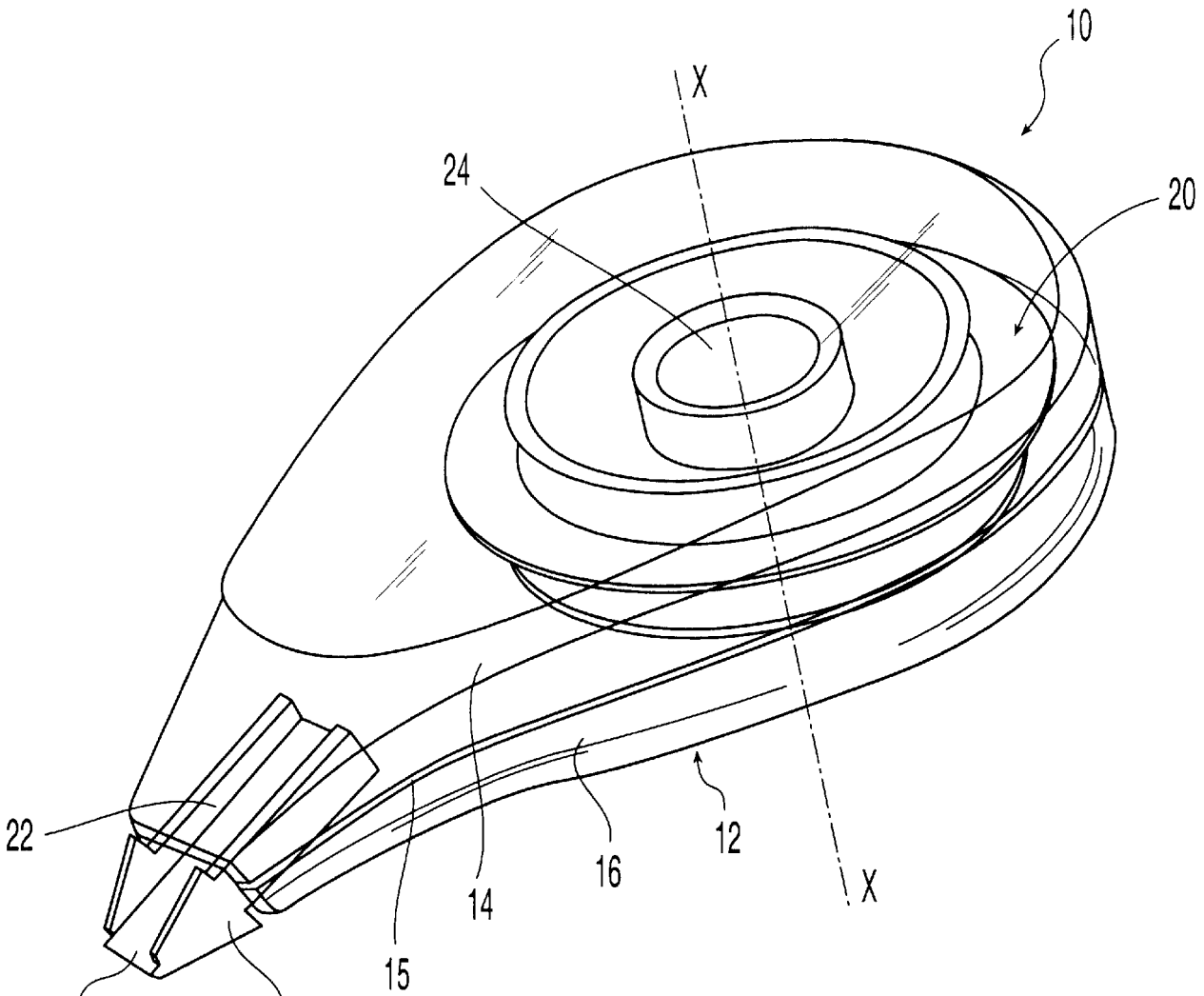
FIG. 1 is a perspective view of a correction tape dispenser incorporating the viscous clutch according to one embodiment of the present invention.
Figure 2:
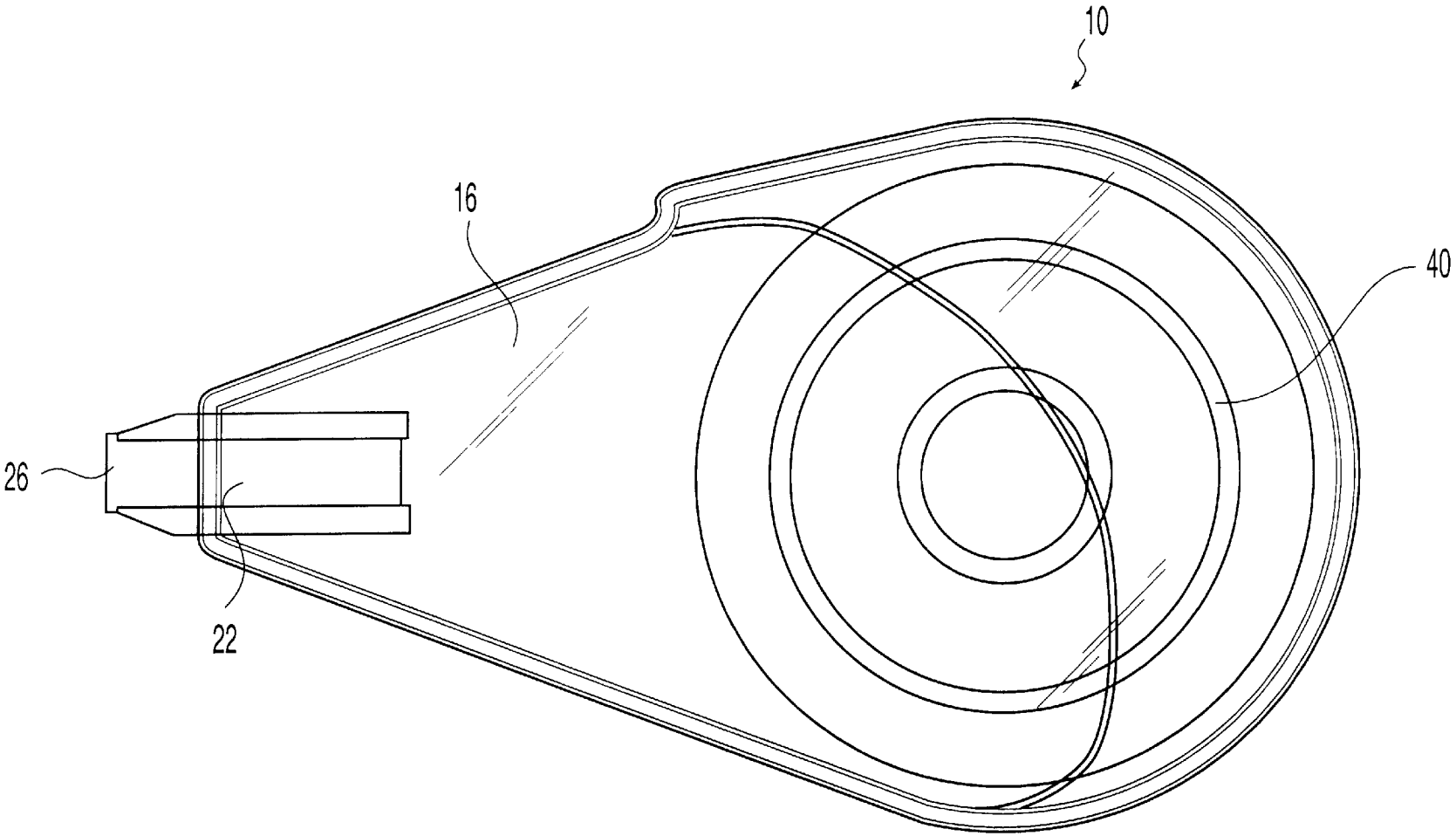
FIG. 2 is a top view of the correction tape dispenser of FIG. 1, showing the take-up reel of the viscous clutch.
Figure 3:
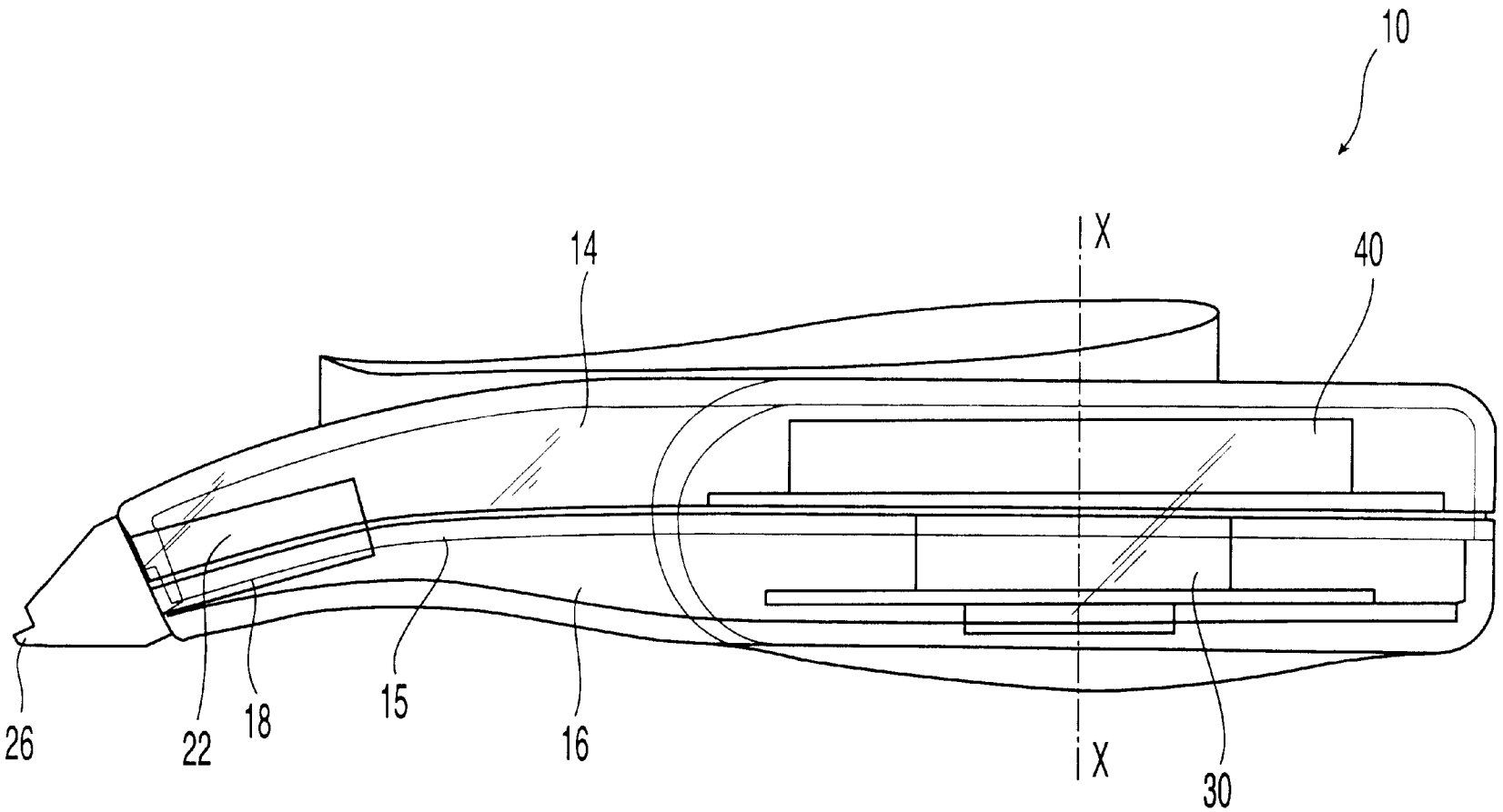
FIG. 3 is a side view of the correction tape dispenser of FIG. 1, showing the take-up reel on the top and the supply reel on the bottom.

A correction tape dispenser that incorporates a reel assembly according to one embodiment of the invention is shown in FIGS. 1–3. The correction tape dispenser depicted is of the single reel variety and incorporates a take-up reel and a supply reel. The dispenser is shown without correction tape, as the type of tape or correction tape is not critical to the invention. In addition, the type of dispenser is also not critical to the invention, as any type of dispenser design is expected to benefit from the present invention. In addition, while a single reel dispenser is shown, double or other reel configurations will also derive a benefit from the viscous clutch of the present invention.

Referring to FIGS. 1–3, a correction tape dispenser 10 is shown as including an outer housing 12 with interior elements. The outer housing 12 includes two parts, a top shell portion 14 and a bottom shell portion 16. The top shell portion 14 and bottom shell portion 16 are configured such that they fit together along a peripheral lip 15 to house and generally enclose the interior elements of the correction tape dispenser 10. The dispenser 10 also includes a dispenser tip 18 and a reel assembly 20. The dispenser tip 18 is positioned within an opening 22 in the housing 12 and extends both inside and outside of the housing 12. The reel assembly 20 is preferably positioned and held on a boss 24, which may be formed as an integral part of the housing 12. The reel assembly 20 may rotate about the boss 24.

The reel assembly 20, as will be discussed in further detail below, holds the correction tape (not shown). The reel assembly 20 includes a supply reel 30 and a take-up reel 40. A length of tape, ribbon or strip of material extends from the supply reel 30 and is guided out of the opening 22 in the housing 12, around the dispenser tip 18, back into the housing and to the take-up reel 40. The dispenser tip 18 has an edge 26, preferably relatively sharp, which is used to press the tape against the surface onto which the correction tape is to be applied. The tape consists of a ribbon or strip of material which in this instance preferably carries a coating of the correction composition. The ribbon may be formed from paper, plastic, or other materials. The coating is preferably positioned on the outer side of the ribbon when it passes around the dispenser tip 18. The tape may be any type of ribbon or strip of material, and preferably includes a layer of correction composition coating on one side of a carrier ribbon. Once the coating is applied to a surface utilizing the dispenser tip 18, the spent tape in the form of the carrier ribbon is wound around a take-up reel 40 of the reel assembly 20 and stored. The dispenser 10 is preferably adapted to be held in the hand of the user.

The supply reel 30 and take-up reel 40 are linked to one another such that rotation of one causes rotation of the other. An unused correction tape roll (not shown) is provided on the supply reel 30. After the correction layer is applied to a surface, the take-up reel 40 automatically recovers the spent tape.

In use, the dispenser 10 preferably is held in the hand of a user and the dispenser tip 18 is pressed down onto a paper (or other substrate surface) so that its edge 26 preferably presses the tape against the surface across the full width of the tape. The correction composition has an adhesive quality and has greater adhesion to the paper than its carrier ribbon so that when the tip 18 is displaced across the paper surface, the tip 18 slides with respect to the ribbon, causing the tape to be drawn off the supply reel 30. The consequent rotation of the supply reel rotates the take-up reel 40 so that a substantially constant tension is maintained in the tape and the take-up reel 40 reels in the spent ribbon. In this way, a continuous strip of correction composition may be laid down onto the paper, with the strip having a length according to the distance traveled by the dispenser tip 18.

The supply reel 30 is dimensioned and configured to carry the roll of correction tape that includes the correction composition disposed on the ribbon. The take-up reel 40 is dimensioned and configured to carry the ribbon after the correction composition has been removed from the ribbon and deposited on a surface. It should be noted, however, that the take-up reel 40 is also configured and dimensioned to house unused portions of the tape, such as portions that are not applied to the surface, but are still taken up onto the take-up reel 40.

The supply reel 30 and take-up reel 40 are rotatable about a common axis X—X that is defined by a boss 24 or post (see FIGS. 1–3 ). The reels 30, 40 are coupled to one another such that rotation of the supply reel 30, in response to the tape being drawn therefrom, causes the take-up reel 40 to rotate. More preferably, the reels 30, 40 are coupled to each other by a viscous clutch 50 which allows slippage of the take-up reel 40 relative to the supply reel 30 so that reel 40 can rotate at a different angular velocity than reel 30. The viscous clutch 50 includes a viscous material 52 which preferably is positioned between portions of mating sections of the take-up reel 40 and the supply reel 30.

In operation, the outside diameter of the unused correction tape roll on the supply reel 30 decreases while the outside diameter of the spent tape on the take-up reel 40 increases. Thus, the diameters of the ribbon material on each reel varies over use of the correction tape and is often different. When the diameter of the tape on the supply reel 30 is greater than the diameter of the ribbon collected on the take-up reel, one revolution of the supply reel unwinds a greater length of tape than one revolution of the take-up reel collects, and slack can develop between the two reels. Conversely, if the supply reel 30 has a tape diameter which is less than the ribbon diameter of the take-up reel 40, one revolution of the supply reel would unwind less tape than one revolution of take-up reel 40 would retrieve, which would apply too much tension on the tape resulting in possible breakage. In order to prevent such a situation, the two reels need to be coupled so that rotation of the supply reel rotates the take-up reel and yet the reels may have different angular or rotational velocities. The viscous coupling allows the reels 30, 40 to slip with respect to one another so that they may have different rotational speeds. Stated differently, without the use of a clutch 50, the take-up speed of the take-up reel 40 would be different over time then the payout speed of the supply reel. An unsynchronized supply reel 30 and take-up reel 40 would result in either too much slack or too much tension in the spent tape. The viscous clutch 50 synchronizes the rotation of the supply reel 30 and take-up reel 40 such that the take-up speed of the take-up reel 40 is at a rate which is nearly the same as the payout speed of correction tape from the supply reel 30.

Figure 5A:
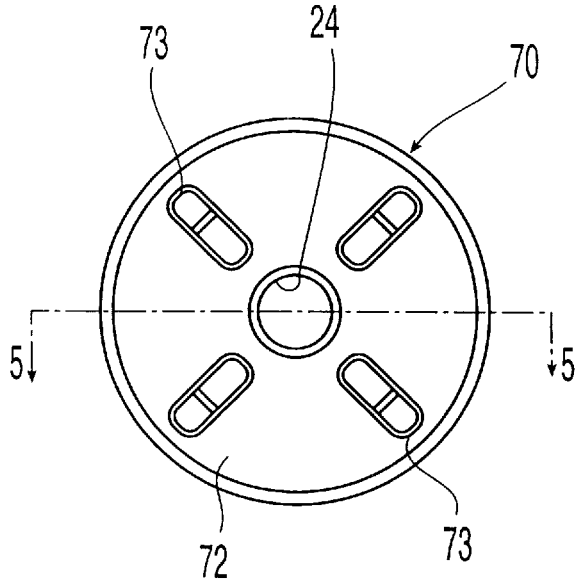
FIG. 5A is a top view of a cartridge that incorporates a viscous clutch according to one embodiment of the current invention.
Figure 5B:
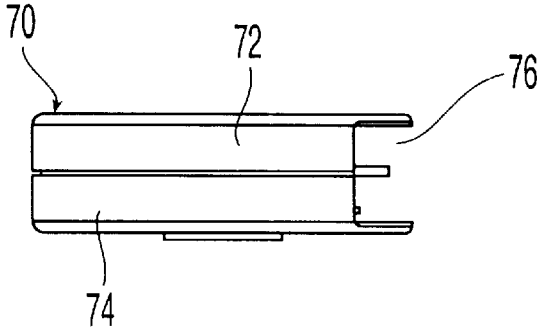
FIG. 5B is a side view of the cartridge shown in FIG. 5A.
Figure 5C:
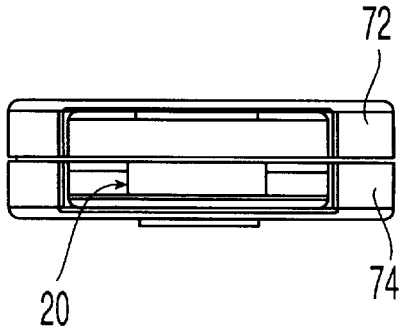
FIG. 5C is a side view that is displaced by 90 degrees relative to the side view of FIG. 5B showing an opening in the cartridge for extending the correction tape.
Figure 5D:
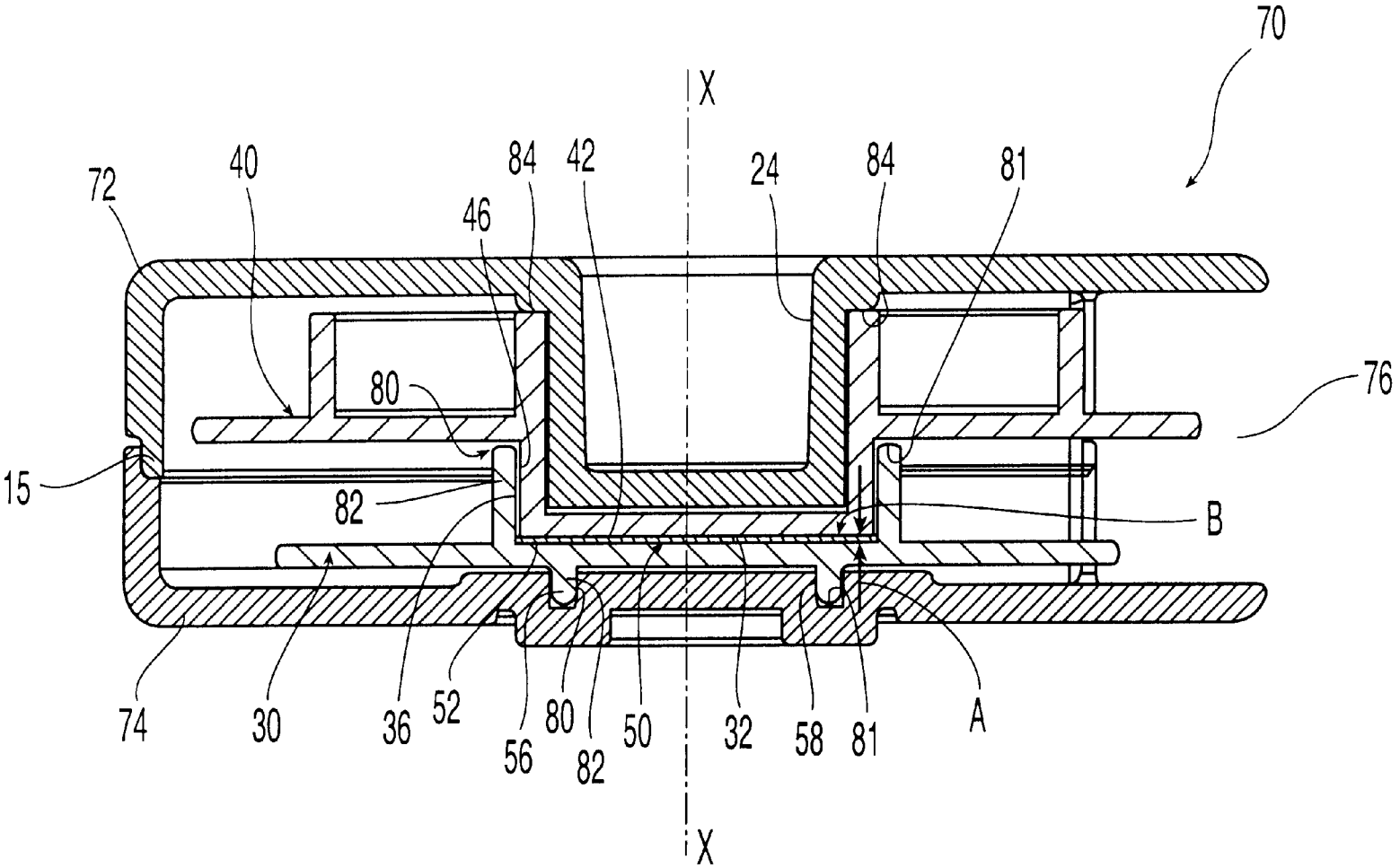
FIG. 5D is a cross-sectional view of the cartridge of FIG. 5A taken at line 5—5.

As shown in FIG. 5D, the viscous material 52 is preferably provided between a clutch surface 42 of the take-up reel 40 and a clutch surface 32 of the supply reel 30. These clutch surfaces 32, 42 are cylindrical in the embodiment depicted. The area B provided between the mating clutch surfaces 32, 42 preferably provides a substantially disc-shaped area for the viscous material 52. The viscous material 52 may be retained between the clutch surfaces 32, 42, or may extend beyond the cylindrical surfaces along the respective inner sides 36, 46 of the supply reel and take-up reel cylinders that are associated with the respective clutch surfaces 32, 42.

Figure 6A:
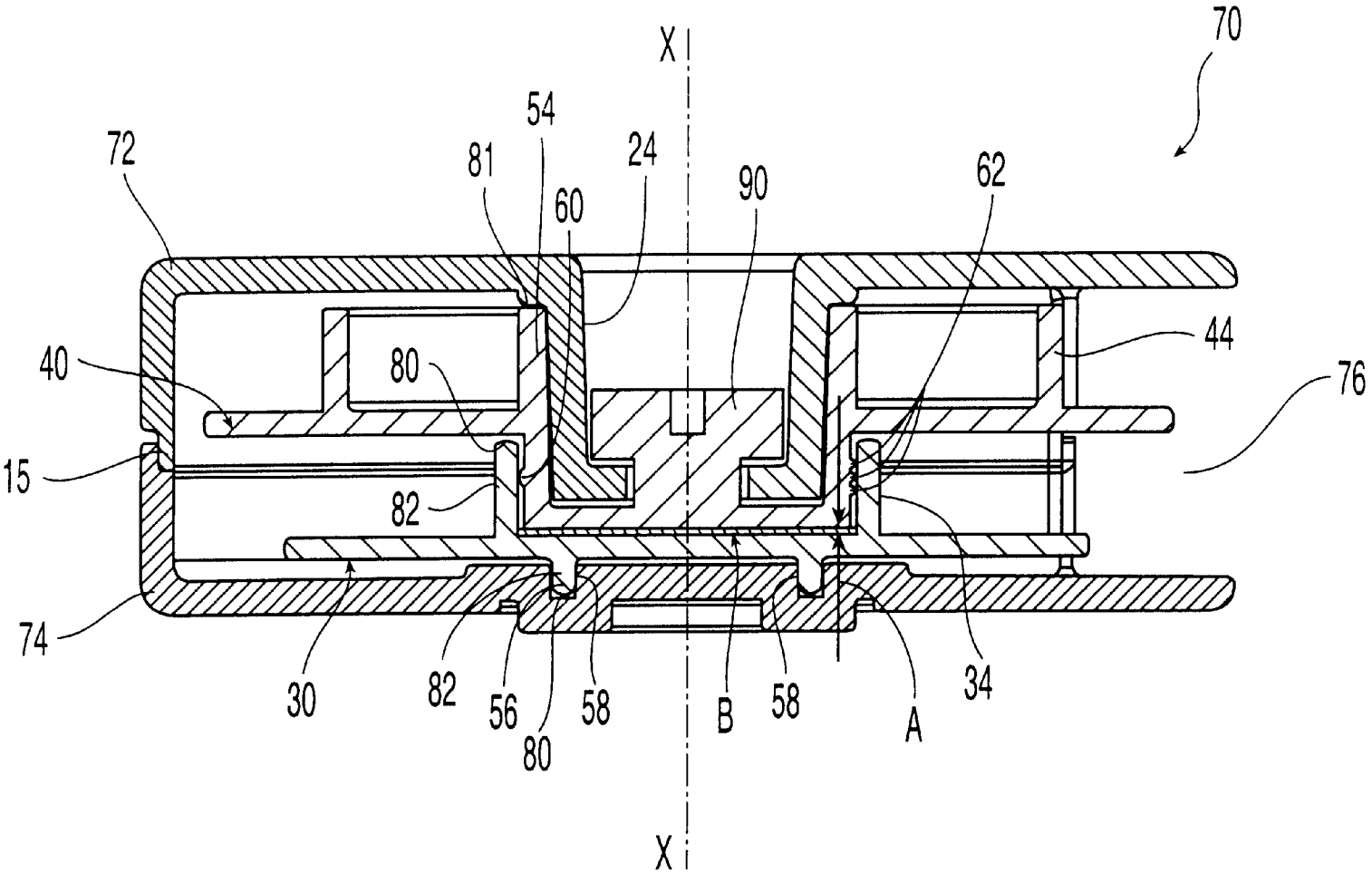
FIG. 6A is a cross-sectional view of the reel assembly according to one embodiment of the present invention showing several different types of seals positioned on the take-up reel for assisting in retaining the viscous material of the clutch between the take-up reel and the supply reel and a knob positioned on the supply reel for use in freeing up the movement of the supply reel.
Figure 6B:
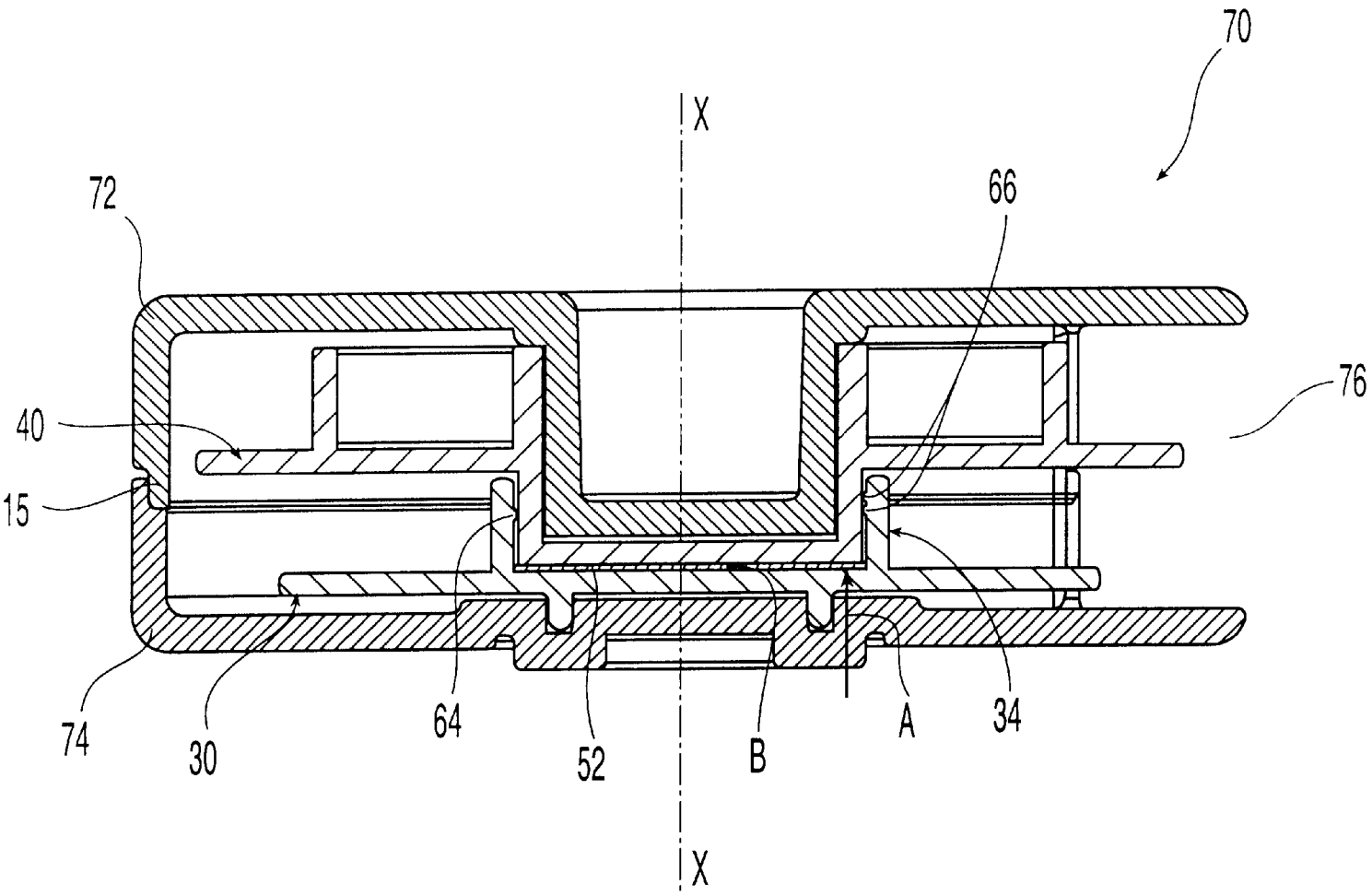
FIG. 6B is a cross-sectional view of the reel assembly according to another embodiment of the present invention showing several different types of seals positioned on the supply reel for assisting in retaining the viscous material between the take-up reel and the supply reel.

If desired, a seal 60 may be provided between the supply reel 30 and the take-up reel in order to retain the viscous material 52 between the two reels 30, 40. This seal 60 may be integrally formed with either the supply reel 30 or the take-up reel 40, or may be formed separately and inserted between the two reels. The separate seal may be formed, for example, of rubber. An example of several seal configurations is shown in FIGS. 6A & 6B. An example of a type of seal that may be used is a labyrinth seal or an "O"-ring. A preferred O-ring is made of a fluoroelastomer, as supplied by Pelmor Laboratories of Newtown, Pa. FIG. 6A shows a single seal 60 on the left side that is integral with the take-up reel 40. On the right side of FIG. 6A, three "O"-ring seals 62 are shown that are positioned between the take-up and supply reels 40, 30. FIG. 6B also shows two different seal configurations. On the left side, a single seal 64 extends outwardly from the supply reel 30. On the right side view of FIG. 6B, two side-by-side seals 66 are provided. The seals 60, 62, 64, 66 may be integral with the reels or separate therefrom. The seals on the left side of FIG. 6 are different from the seals on the right side of FIG. 6 for illustrative purposes only. Obviously, the seals on both sides preferably would be the same in any actual reel assembly, although this is not critical to the invention.

Figure 6C:
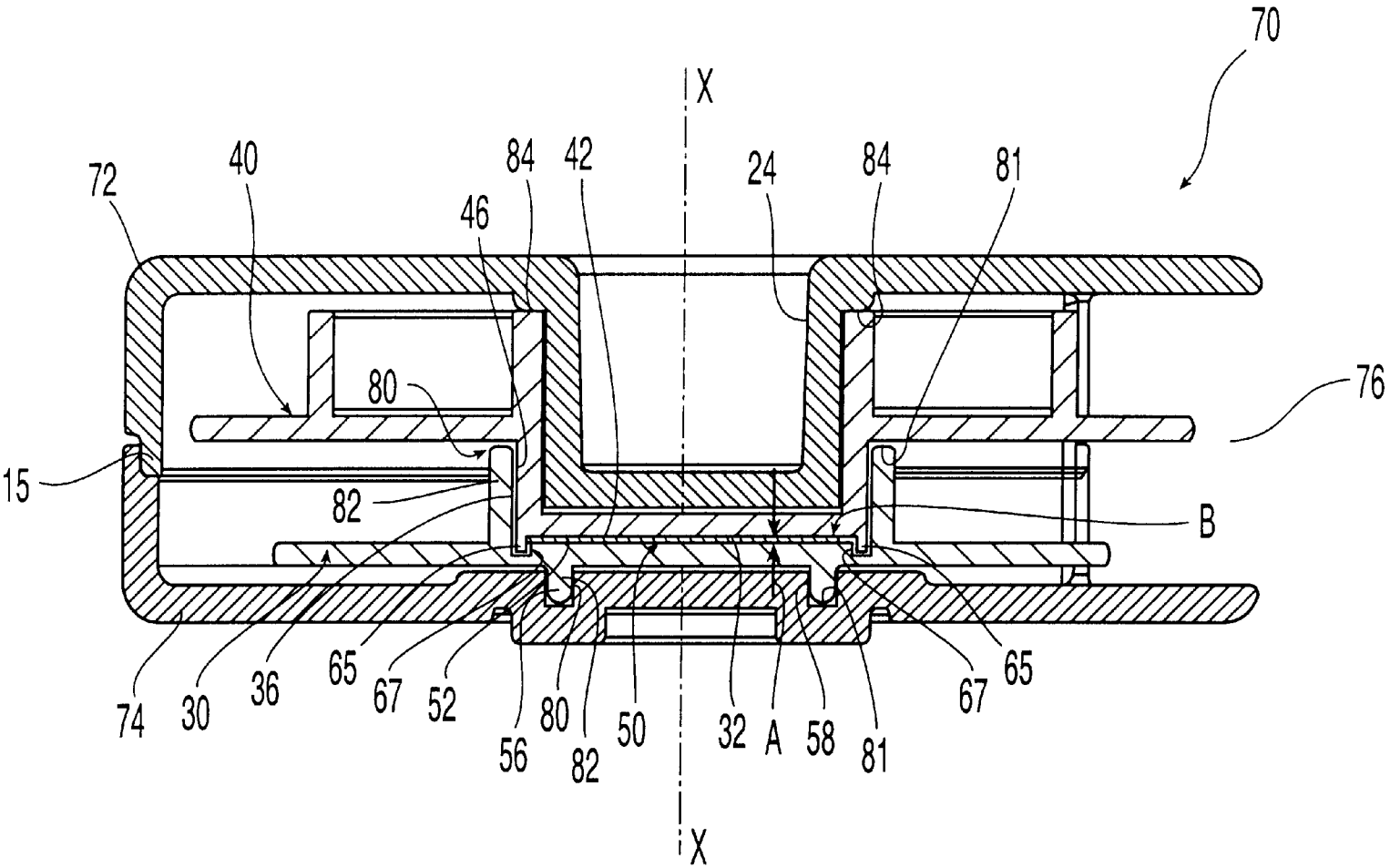
FIG. 6C is a cross-sectional view of the reel assembly according to another embodiment of the invention showing a different configuration for the clutch surfaces to assist in retaining the viscous material between the take-up and supply reels.
Figure 7A:
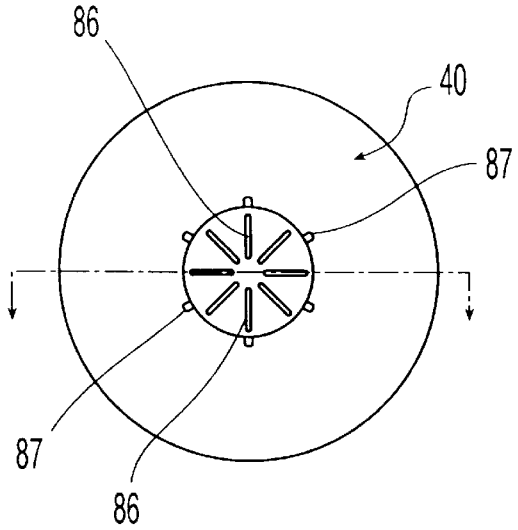
FIG. 7A is a bottom view of the take-up reel of one embodiment of the current invention showing the provision of radial ribs in the clutch region.
Figure 7B:
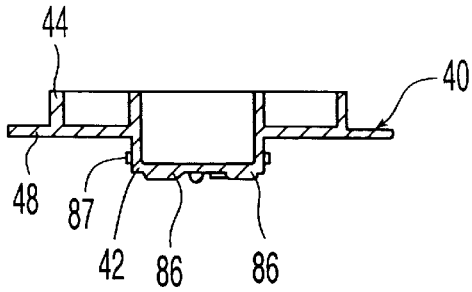
FIG. 7B is a cross-sectional view of the take-up reel of FIG. 7A.

FIG. 6C shows another form of seal which may be formed in the clutch area in order to maintain the viscous material 52 in the clutch 50. In this embodiment, a cylindrical wall 65 extends downwardly around the periphery of the take-up reel clutch surface 42. A complementary indentation 67 is provided around the periphery of the supply reel clutch surface 32 so that the cylindrical wall 65 seats in the indentation 67. Clearances are provided so that an area A is preferably provided between the clutch surfaces 32, 42. The viscous material 52 is positioned in the area A between the clutch surfaces 32, 42. Due to the use of a cylindrical wall 65 that seats in indentations 67, an enclosed area is provided between the clutch surfaces 32, 42 for maintaining the viscous material 50.

Other types of seals are also contemplated to be within the scope of the invention. Depending upon the type of material used in the clutch, the use of seals maybe advantageously provided. For example, a material that is more likely to escape from the space between the take-up reel 40 and the supply reel 30 may require a seal. However, there are other materials, such as those described below, which may not escape and, therefore, will not require a seal. Therefore, a seal may be utilized where necessary or desired, but is not critical to the invention. Seals may also be provided between other parts of the reel assembly, cartridge, or dispenser. Alternatively, a material or fluid other than a seal may be used to maintain the viscous material in the clutch. For instance, fluorosilicone elastomers may be utilized to hold the viscous material 52 in the clutch 50.

While the mating clutch surfaces 32, 42 of the supply reel 30 and take-up reel 40 are discussed and shown as being substantially cylindrical, it should be noted that other shapes are contemplated for the clutch surfaces 32, 42 and viscous clutch 50. For instance, the clutch surfaces may be cone-shaped such that the viscous material forms a layer between mating cones. Other shapes, such as mating buckets, cylinders, concave surfaces, convex surfaces, or other shapes are believed to be within the scope of the present invention. The invention is not to be limited to a specific mating surface shape.

Referring again to FIGS. 4A–4D, the supply reel 30 includes a tape carrier surface 34 in the form of a ledge for carrying a roll of correction tape and the take-up reel 40 includes a tape carrier surface 44 in the form of a ledge for carrying a roll of spent correction tape. The supply reel tape carrier surface 34 preferably has a smaller diameter than the diameter of the take-up reel tape carrier surface 44. A smaller diameter supply reel tape carrier surface 34 is used in order to assist in providing proper tension to the correction tape as it reels from the supply reel 30 to the take-up reel 40.

The diameters of the supply reel tape carrier surface 34 and the take-up reel tape carrier surface 44 may be configured to provide proper tension based upon the characteristics of the viscous material 52 that is selected to be placed in the viscous clutch 50.

One reason for providing a smaller diameter supply reel tape carrier surface 34 relative to a larger diameter take-up reel tape carrier surface 44 is to take into account the change in tape thickness after the correction composition on the carrier ribbon has been applied to a substrate surface. In particular, prior to application, the tape on the supply reel includes both the carrier ribbon and the correction composition. During proper application, the correction composition is substantially removed from the carrier ribbon and applied to a surface, thereby leaving the empty carrier ribbon. This carrier ribbon has a reduced thickness relative to the original correction tape. Thus, as the carrier ribbon is wound upon the take-up reel 40, it requires less space on the reel 40. As a result the diameter of the ribbon on the take-up reel 40 is reduced relative to the diameter of the correction tape in its unused state on the supply reel 30. The provision of a larger diameter take-up reel tape carrier surface 44 helps to equalize the diameter of the correction tape on the supply reel 30 to the diameter of the carrier ribbon collected on the take-up reel 40, so the clutch 50 does not have to accommodate large variations in the rotational speeds between the supply reel and take-up reel.

Figure 4A:
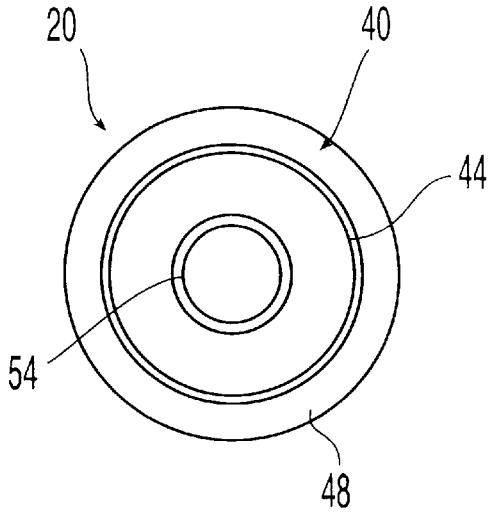
FIG. 4A is a top view of the reel assembly of the viscous clutch of one embodiment of the current invention that incorporates both the supply reel and the take-up reel.
Figure 4C:
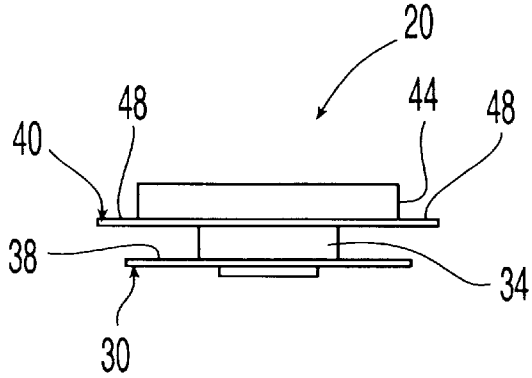
FIG. 4C is a side view of the reel assembly of FIG. 4A.
Figure 4B:
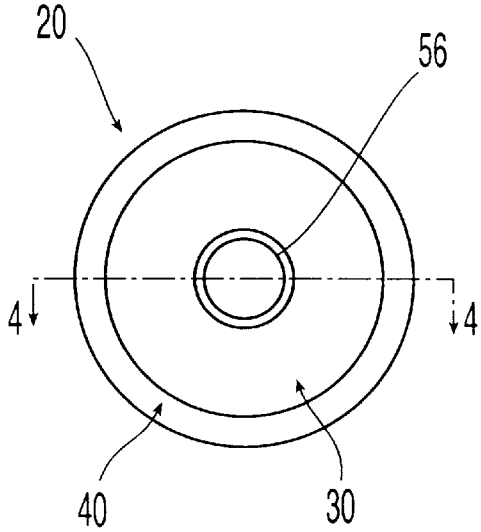
FIG. 4B is a bottom view of the reel assembly of FIG. 4A.
Figure 4D:
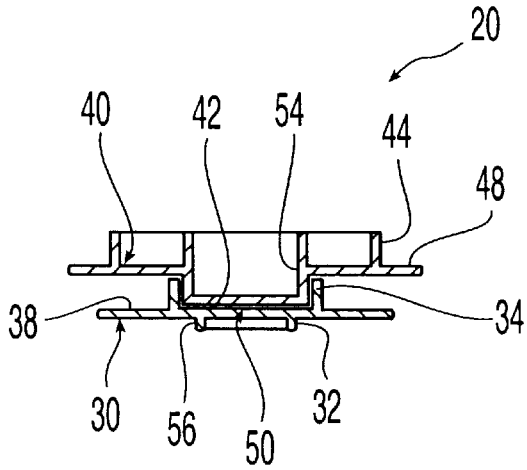
FIG. 4D is a cross-sectional view of the reel assembly of FIG. 4B taken at line 4—4.

As further shown in FIGS. 4A–4D, the supply reel 30 includes a face or reel side portion 38 for retaining the roll of correction tape in position. The take-up reel 40 also includes a face or reel side portion 48 for retaining the roll of spent correction tape. Each side portion 38, 48 preferably is of a length that is sufficient to retain the full roll of unused or used correction tape, respectively. As is shown in FIG. 4D, it is expected that the side 48 of the take-up reel 40 may be of a shorter length than the length of the side portion 38 of the supply reel 30, although this is not critical to the invention. It is preferred that each side portion 38, 48 be sufficient to at least hold the entire roll of used or unused correction tape, respectively.

The take-up reel 40 and the supply reel 30 also include portions for mating with the boss 24 formed on the top shell portion 14, or on the cartridge (shown in FIG. 5A). As shown in FIG. 4D, the take-up reel 40 includes an axle boss 54 for mating with a boss 24 and the supply reel 30 includes an axle boss 56 for mating with a groove 58 defined in the bottom shell portion 16. In the single reel arrangement shown, the axle boss 56 is preferably aligned along the same axis as the take-up reel axle boss 54, such that the take-up reel 40 and supply reel 30 rotate upon a common axis X—X. It should be noted, however, that the invention is also applicable to a double reel design, wherein the axes of the reels do not align.

The viscous material 52 mechanically links the supply reel 30 to the take-up reel 40. The mechanical force transmitted by dispensing the tape from the supply reel 30 to the take-up reel 40 is transmitted through the viscous material 52 in the clutch 50. The viscous material 52 allows the take-up reel 40 to slip during operation so that tension in the tape does not build up to a point where the tape will break, or even to a point where performance is poor.

The viscous material 52 is preferably provided in area B between the take-up reel 40 and supply reel 30. A number of different viscous materials may be utilized in the viscous clutch 50. The viscous material 52 may be a liquid, gel, solid, other material, or combinations thereof. In a preferred embodiment, the viscous material is a mixture of low viscosity organo-siloxanes, such as silicone liquids, with high viscosity gums, such as silicone gels. Low viscosity organo-siloxanes may be used to reduce or tune the high viscosities of silicone gums. The ratios between the gums and siloxanes may be adjusted to achieve the preferred drag characteristics between the take-up reel and supply reel. The siloxanes in combination with the gums are preferably well mixed to form a homogenous mixture.

Preferred low viscosity organo-siloxanes are produced by Sil-Tech Corporation, of Tecumseh, Mich. Such low viscosity materials include:

| Code Name | Viscosity |
|---|---|
| ST-14 | 0.65 centistokes |
| ST-16 | 1.0 centistokes |
| ST-18 | 1.5 centistokes |
| ST-20 | 2.0 centistokes |
| ST-15 | 15 centistokes |
| ST-22 | 500 centistokes |

Preferred silicone gels (also commonly referred to as Silicone Gums) are ST-29, having a viscosity of 24,000 centistokes, and ST-920, having a viscosity of 2 million centistokes. An example of a preferred mixture includes ST-920 combined with ST-22 (polydimethylsiloxane). The materials are preferably mixed in quantities of about 1:1.

Other types of materials may also be utilized. For instance, a silicone liquid, polybutylene, or dilatant fluid may be used. Silicone, as a chemical class, is preferred because it is inert and stable. The viscous material may be clear, colorless, hazy, paste-like, or colored. A coloring agent may be added to the viscous material if so desired for aesthetic reasons. The color of the viscous material is not critical to the invention.

Referring to FIGS. 5A–5D, another embodiment of the invention is shown as including a cartridge 70 that includes a top shell 72, a bottom shell 74, and the reel assembly of the invention. The top shell 72 is shown with openings 73. Openings 73 are optional and are utilized in order to reduce the amount of material utilized in manufacturing the cover. Alternatively, openings 73 may serve as viewing windows in order to determine how much tape is remaining on the supply reel 30. Openings 73 may be provided on both the top shell 72 and the bottom shell 74 (not shown on bottom shell 74 ).

The cartridge 70 includes an opening 76 out of which the correction tape can extend to a dispenser tip (not shown in FIGS. 5A–5D). The cartridge 70 may be used as a replacement tape cartridge for a correction tape dispenser. An enlarged view of the reel assembly 20 is shown in FIG. 5D, including thickness A and area B where the viscous material 52 is situated within the viscous clutch 50. The top shell 72 includes a boss 24 for mating with the take-up reel 40 and the bottom shell 74 includes a portion 58 for mating with the supply reel 30.

While cartridge 70 is shown as including an outer shell with the reel assembly provided inside the cartridge, other forms of replaceable cartridges are also contemplated. For instance, it is not required that the replacement cartridge include an outer shell. A replacement "cartridge" may simply include the reel assembly, which may be inserted into the outer housing of the type shown in FIGS. 1–3. Other types of housings are also contemplated to be useful with the invention, the invention not being limited to a particular housing or a particular replacement cartridge design. The reel assembly 20 may be disposable so that it is removable from the housing of the correction tape dispenser 10 and easily replaced with a replacement reel assembly 20.

As shown in FIG. 5D, dimensional controls are provided within the reel assembly 20 in order to provide proper clearance for the viscous material 52 in the clutch 50. As discussed above, "A" in the drawing illustrates the thickness provided between the mating surfaces 32, 42 of the take-up reel 40 and supply reel 30. Thickness A is preferably maintained at at least about 0.01 inches, but this space may vary based on the type of viscous material 52 utilized. Area "B" is formed between the mating surfaces and may vary depending upon thickness "A". Some materials may need a greater thickness "A" and, thus, a larger area "B" than others in order to function properly.

Dimensional controls are utilized to avoid pressing the viscous material 52 out of the clutch 50. In order to ensure proper spacing, it is desirable to provide stops 80 that serve to promote thickness A between the take-up reel 40 and the supply reel 30. These stops 80 are provided by the cylindrical walls 82 that extend from the supply reel 30 to a tip end 81 of walls 82. These walls 82 abut the bottom shell 16 on one side and the take-up reel 40 on the other side. In a preferred embodiment, the tip end 81 of the walls 82, which is the portion that abuts the take-up reel 40 and bottom shell 74, are radiused in order to reduce or eliminate friction between the parts, although this is not critical to the invention. Other dimensional controls are also provided by the walls of the take-up reel 40, and by the top shell 72. The top shell 72 includes an external lip 15 that mates with the bottom shell 74. In addition, take-up reel 40 includes a stop 84 for abutting the top shell 72, which serves to allow proper positioning of the reel assembly 20 in the cartridge 70.

Figure 8A:
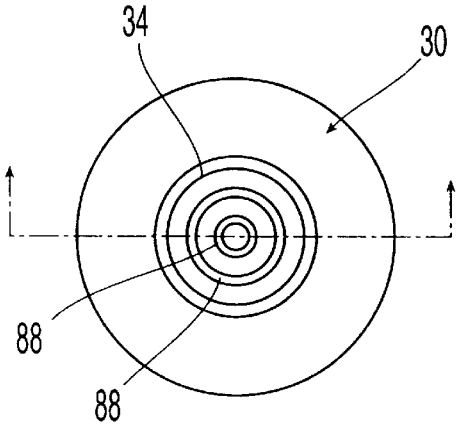
FIG. 8A is a top view of the supply reel of one embodiment of the current invention showing the provision of concentric ribs in the clutch region.
Figure 8B:
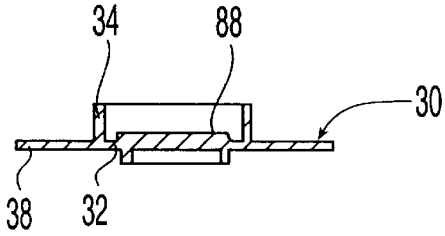
FIG. 8B is a cross-sectional view of the take-up reel of FIG. 8A.

Referring to FIGS. 7A, 7B, 8A, and 8B, ribs may be provided within the viscous clutch 50 in order to increase the area of the contact between the reels 30, 40 and the viscous material 52. An example of one embodiment of ribs is provided in FIGS. 7A and 7B, which show radial ribs 86 that extend outwardly from the center of the mating clutch surface 42 of the take-up reel 40. Ribs 87 are also provided on the cylindrical wall 46 of the take-up reel 40 of this embodiment. The ribs on the mating clutch surface or the walls may be used alone or together. FIGS. 8A and 8B show concentric ribs 88 disposed on the mating clutch surface 32 of the supply reel 30. Any type of rib may be useful in the clutch region 50. Other shaped ribs may also be utilized alone or in combination with other types of ribs, the invention not being limited to the shapes shown. In addition to, or instead of, ribs, other surface treatments may be used, such as textures, for example. Surface treatments, such as textures, ribs, or other treatments increase friction between the reels. They also allow the surface area within the clutch to be made smaller and the sealing area to be reduced. Surface treatments are also useful in slowing down potential viscous fluid degradation since friction is created between the reels and less stress is placed on the fluid. Therefore, it should be noted that area B between the mating clutch surfaces 32, 42 of the take-up reel 40 and the supply reel 30 may be changed depending upon the type of surface treatment provided. Furthermore, textures or other surface treatments may be provided on the supply reel surface, the take-up reel surfaces, or both.

As shown in FIG. 6A, a mechanism for activating the clutch may be provided in the event that the viscous material sets or sticks after periods of non-use. For example, a knob, as shown in FIG. 6A may be provided on the take-up reel 40 of the housing. The knob 90 is accessible through boss 24 provided in the top shell 72 of housing 12. The knob may be provided at any number of locations and may, alternatively, be associated with the supply reel 30. In addition, when the knob 90 is provided on one of the take-up reel 40 or the supply reel 30, a mechanism may be provided for holding the other reel stationary such as an opening for holding a notch disposed in the other reel (not shown). A mechanism for holding the other reel stationary may not be necessary since the tape may assist in allowing rotation of the one reel to free its movement.

While various descriptions, embodiments, and aspects of the present invention are described above, it should be understood that the various features can be used singly or in any combination thereof. Each of the separate embodiments of the FIGS. may be used in conjunction with or side-by-side with the other embodiments. Therefore, this invention is not to be limited to only the specifically preferred embodiments depicted herein.

Further, it should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention.

What is claimed is:

1. A reel assembly for use in a tape dispenser comprising:

a supply reel;

a take-up reel in mating association with the supply reel;

a viscous material positioned between the supply reel and the take-up.

2. The reel assembly of claim 1, wherein the viscous material couples the supply reel and the take-up reel and provides controlled drag between the supply reel and take-up reel in order to properly tension a tape being dispensed from a tape dispenser.

3. The reel assembly of claim 1, wherein the take-up reel includes a mating portion and the supply reel includes a mating portion, and the viscous material is positioned between the mating portion of the take-up reel and the mating portion of the supply reel.

4. The reel assembly of claim 3, wherein the mating portion of the take-up reel and the mating portion of the supply reel define an area which is substantially disk shaped and the viscous material is positioned within the area.

5. The reel assembly of claim 1, wherein the viscous material comprises a silicone substance.

6. The reel assembly of claim 5, wherein the viscous material comprises a mixture of a silicone gum and a silicone fluid.

7. The reel assembly of claim 1, wherein the supply reel includes a tape carrier surface for holding a roll of correction tape and the take-up reel includes a tape carrier surface for accepting spent correction tape, with each of the supply reel tape carrier surface and the take-up reel tape carrier surface having a diameter.

8. The reel assembly of claim 7, wherein the supply reel tape carrier surface diameter is smaller than the take-up reel tape carrier surface.

9. The reel assembly of claim 1, wherein a seal is provided between the take-up reel and the supply reel, said seal being configured and dimensioned to retain the viscous fluid between the take-up reel and the supply reel.

10. The reel assembly of claim 9, wherein the seal extends outwardly from a wall of the take-up reel.

11. The reel assembly of claim 9, wherein the seal is an independent member positioned between the supply reel and the take-up reel in the vicinity of the viscous material.

12. The reel assembly of claim 1, wherein a mechanism is provided for increasing the friction between the supply reel and the take-up reel.

13. The reel assembly of claim 1, wherein at least one rib is positioned on at least one of the supply reel or the take-up reel, and said at least one rib is in association with the viscous material.

14. The reel assembly of claim 13, wherein the at least one rib is selected from at least one of the group consisting of a concentric rib and a radial rib.

15. The reel assembly of claim 1, wherein a surface treatment is provided on at least one of the supply reel or the take-up reel, and the surface treatment is in association with the viscous material.

16. The reel assembly of claim 1, which further comprises at least one dimensional control for ensuring that an area is maintained between at least part of the supply reel and at least part of the take-up reel for holding the viscous material.

17. The reel assembly of claim 16, wherein the dimensional controls comprise a cylindrical wall of the supply reel that abuts a surface on the take-up reel.

18. The reel assembly of claim 1, further comprising a knob associated with at least one of the supply reel or the take-up reel for rotating the supply reel or the take-up reel relative to the other reel.

19. The reel assembly of claim 1, wherein the supply reel has an axis and the take-up reel has an axis, and the axis of the take-up reel is not coaxial with the axis of the supply reel.

20. A cartridge for housing a reel assembly of a correction tape dispenser comprising:

the reel assembly of claim 1; and a body for housing the reel assembly, said body having at least one opening defined therein for the entrance and exit of a tape.

21. The cartridge of claim 20, wherein the body comprises a top shell portion in mating association with a bottom shell portion, and wherein the body is configured and dimensioned for insertion into a correction tape dispenser.

22. A correction tape dispenser comprising:

a body forming the outside of the correction tape dispenser;

a reel assembly positioned within the body and having a viscous clutch; and a dispenser tip positioned within said body and having a portion extending therefrom.

23. The correction tape dispenser of claim 22, wherein the reel assembly is mounted on a boss that extends from the body of the correction tape dispenser.

24. The correction tape dispenser of claim 22, wherein the reel assembly includes a take-up reel and a supply reel, the supply reel for housing a roll of unused correction tape and the take-up reel for housing used correction tape.

25. The correction tape dispenser of claim 24, wherein said take-up reel includes a mating portion and the supply reel includes a mating portion, and the viscous clutch is positioned between the mating portion of the take-up reel and the mating portion of the supply reel.

26. The correction tape dispenser of claim 25, wherein the mating portion of the take-up reel and the mating portion of the supply reel define an area that is substantially disk shaped.

27. The correction tape dispenser of claim 25, wherein the viscous clutch comprises a viscous material provided between the mating portion of the take-up reel and the mating portion of the supply reel, such that the viscous material couples and provides controlled drag between the supply reel and the take-up reel.

28. The correction tape dispenser of claim 27, wherein the viscous material is a mixture of at least a silicone fluid and a silicone gum.

29. The correction tape dispenser of claim 27, wherein the viscous material is a silicone substance.

30. The correction tape dispenser of claim 27, wherein a surface treatment is provided on at least one of the mating portions of the supply reel or the take-up reel and the surface treatment contacts the viscous material.

31. The correction tape dispenser of claim 25, which further comprises a knob associated with the reel assembly for manually rotating at least one of the take-up reel or the supply reel, said knob being accessible from outside the body.

32. The correction tape dispenser of claim 22, which further comprises a correction tape disposed on the reel assembly and extending from the reel assembly around the dispenser tip and back to the reel assembly, wherein the dispenser tip is for application of the correction tape.

* * * * *